US009453347B2

(12) United States Patent
Pervan

(10) Patent No.: US 9,453,347 B2
(45) Date of Patent: Sep. 27, 2016

(54) MECHANICAL LOCKING SYSTEM FOR FLOOR PANELS

(71) Applicant: Välinge Innovation AB, Viken (SE)

(72) Inventor: Darko Pervan, Viken (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 14/538,223

(22) Filed: Nov. 11, 2014

(65) Prior Publication Data

US 2015/0059281 A1 Mar. 5, 2015

Related U.S. Application Data

(63) Continuation of application No. 14/011,042, filed on Aug. 27, 2013, now Pat. No. 8,898,988, which is a continuation of application No. 12/977,399, filed on Dec. 23, 2010, now Pat. No. 8,544,230.

(60) Provisional application No. 61/294,217, filed on Jan. 12, 2010.

(51) Int. Cl.
*E04B 2/00* (2006.01)
*E04F 15/02* (2006.01)
(Continued)

(52) U.S. Cl.
CPC ..... *E04F 15/02038* (2013.01); *E04C 2/30* (2013.01); *E04C 2/40* (2013.01);
(Continued)

(58) Field of Classification Search
CPC ..... E04F 15/10; E04F 15/107; E04F 15/02; E04F 15/02005; E04F 15/02038; E04F 2201/03; E04F 2201/04; E04F 2201/041; E04F 2201/042; E04F 2201/043; E04F 2201/044; E04F 2201/045; E04F 2201/046
USPC ..... 52/390, 392, 533, 534, 539, 553, 578, 52/582.1, 586.1, 586.2, 588.1, 589.1, 52/590.2, 590.3, 591.1, 591.2, 591.3, 52/591.4, 591.5, 592.1, 592.2, 592.4, 52/745.08, 745.19, 747.1, 747.11, 748.1, 52/748.11; 403/345, 364–368, 372, 375, 403/376, 381; 404/34, 35, 40, 41, 46, 47, 404/49–58, 68, 70; 428/47–50, 57, 58, 60, 428/61, 106, 192–194
See application file for complete search history.

(56) References Cited

U.S. PATENT DOCUMENTS 87,853 A 3/1869 Kappes
108,068 A 10/1870 Utley
(Continued)

FOREIGN PATENT DOCUMENTS

CA 2456513 2/2003
CN 201588375 U 9/2010
(Continued)

OTHER PUBLICATIONS

U.S. Appl. No. 14/701,959, Pervan, et al.
(Continued)

*Primary Examiner* — William Gilbert
(74) *Attorney, Agent, or Firm* — Buchanan Ingersoll & Rooney P.C.

(57) ABSTRACT

Floor panels (1*b*, 1*c*) provided with a mechanical locking system made of a separate material in order to reduce snapping resistance during vertical displacement, for example, a flexible tongue. Mechanical locking systems for floor panels and building panels especially floor panels with mechanical locking systems, which are possible to lock with a vertical displacement.

13 Claims, 7 Drawing Sheets

(51) Int. Cl.

| | |
|---|---|
| ***E04F 15/04*** | (2006.01) |
| ***E04F 15/10*** | (2006.01) |
| ***E04C 2/40*** | (2006.01) |
| ***E04C 2/30*** | (2006.01) |
| *E04C 2/00* | (2006.01) |

(52) U.S. Cl.

CPC ..... *E04F15/02022* (2013.01); *E04F 15/04* (2013.01); *E04F 15/10* (2013.01); *E04C 2002/004* (2013.01); *E04F 2201/0138* (2013.01); *E04F 2201/0523* (2013.01); *Y10T 428/167* (2015.01)

(56) References Cited

U.S. PATENT DOCUMENTS

| | | | |
|---|---|---|---|
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,204,675 | A | 6/1940 | Grunert |
| 2,266,464 | A | 12/1941 | Kraft |
| 2,277,758 | A | 3/1942 | Hawkins |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,858,584 | A | 11/1958 | Gaines |
| 2,863,185 | A | 12/1958 | Riedi |
| 2,865,058 | A | 12/1958 | Andersson |
| 2,889,016 | A | 6/1959 | Warren |
| 3,023,681 | A | 3/1962 | Worson |
| 3,077,703 | A | 2/1963 | Bergstrom |
| 3,099,110 | A | 7/1963 | Spaight |
| 3,147,522 | A | 9/1964 | Schumm |
| 3,271,787 | A | 9/1966 | Clary |
| 3,325,585 | A | 6/1967 | Brenneman |
| 3,331,180 | A | 7/1967 | Vissing et al. |
| 3,378,958 | A | 4/1968 | Parks et al. |
| 3,396,640 | A | 8/1968 | Fujihara |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,572,224 | A | 3/1971 | Perry |
| 3,579,941 | A | 5/1971 | Tibbals |
| 3,720,027 | A | 3/1973 | Christensen |
| 3,722,379 | A | 3/1973 | Koester |
| 3,731,445 | A | 5/1973 | Hoffmann et al. |
| 3,742,669 | A | 7/1973 | Mansfeld |
| 3,760,547 | A | 9/1973 | Brenneman |
| 3,760,548 | A | 9/1973 | Sauer et al. |
| 3,778,954 | A | 12/1973 | Meserole |
| 3,849,235 | A | 11/1974 | Gwynne |
| 3,919,820 | A | 11/1975 | Green |
| 3,950,915 | A | 4/1976 | Cole |
| 3,994,609 | A | 11/1976 | Puccio |
| 4,007,994 | A | 2/1977 | Brown |
| 4,030,852 | A | 6/1977 | Hein |
| 4,037,377 | A | 7/1977 | Howell et al. |
| 4,041,665 | A | 8/1977 | de Munck |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,104,840 | A | 8/1978 | Heintz et al. |
| 4,107,892 | A | 8/1978 | Bellem |
| 4,113,399 | A | 9/1978 | Hansen, Sr. et al. |
| 4,169,688 | A | 10/1979 | Toshio |
| RE30,154 | E | 11/1979 | Jarvis |
| 4,196,554 | A | 4/1980 | Anderson |
| 4,227,430 | A | 10/1980 | Janssen et al. |
| 4,299,070 | A | 11/1981 | Oltmanns |
| 4,304,083 | A | 12/1981 | Anderson |
| 4,426,820 | A | 1/1984 | Terbrack |
| 4,447,172 | A | 5/1984 | Galbreath |
| 4,512,131 | A | 4/1985 | Laramore |
| 4,599,841 | A | 7/1986 | Haid |
| 4,648,165 | A | 3/1987 | Whitehorne |
| 4,819,932 | A | 4/1989 | Trotter, Jr. |
| 5,007,222 | A | 4/1991 | Raymond |
| 5,026,112 | A | 6/1991 | Rice |
| 5,071,282 | A | 12/1991 | Brown |
| 5,135,597 | A | 8/1992 | Barker |
| 5,148,850 | A | 9/1992 | Urbanick |
| 5,173,012 | A | 12/1992 | Ortwein et al. |
| 5,182,892 | A | 2/1993 | Chase |
| 5,247,773 | A | 9/1993 | Weir |
| 5,272,850 | A | 12/1993 | Mysliwiec et al. |
| 5,274,979 | A | 1/1994 | Tsai |
| 5,295,341 | A | 3/1994 | Kajiwara |
| 5,344,700 | A | 9/1994 | McGath et al. |
| 5,348,778 | A | 9/1994 | Knipp et al. |
| 5,373,674 | A | 12/1994 | Winter, IV |
| 5,465,546 | A | 11/1995 | Buse |
| 5,485,702 | A | 1/1996 | Sholton |
| 5,502,939 | A | 4/1996 | Zadok et al. |
| 5,548,937 | A | 8/1996 | Shimonohara |
| 5,577,357 | A | 11/1996 | Civelli |
| 5,598,682 | A | 2/1997 | Haughian |
| 5,618,602 | A | 4/1997 | Nelson |
| 5,634,309 | A | 6/1997 | Polen |
| 5,658,086 | A | 8/1997 | Brokaw et al. |
| 5,694,730 | A | 12/1997 | Del Rincon et al. |
| 5,755,068 | A | 5/1998 | Ormiston |
| 5,860,267 | A | 1/1999 | Pervan |
| 5,899,038 | A | 5/1999 | Stroppiana |
| 5,910,084 | A | 6/1999 | Koike |
| 5,950,389 | A | 9/1999 | Porter |
| 5,970,675 | A | 10/1999 | Schray |
| 6,006,486 | A | 12/1999 | Moriau |
| 6,029,416 | A | 2/2000 | Andersson |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,203,653 | B1 | 3/2001 | Seidner |
| 6,254,301 | B1 | 7/2001 | Hatch |
| 6,295,779 | B1 | 10/2001 | Canfield |
| 6,314,701 | B1 | 11/2001 | Meyerson |
| 6,332,733 | B1 | 12/2001 | Hamberger |
| 6,339,908 | B1 | 1/2002 | Chuang |
| 6,345,481 | B1 | 2/2002 | Nelson |
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,449,918 | B1 | 9/2002 | Nelson |
| 6,450,235 | B1 | 9/2002 | Lee |
| 6,490,836 | B1 | 12/2002 | Moriau et al. |
| 6,505,452 | B1 | 1/2003 | Hannig |
| 6,546,691 | B2 | 4/2003 | Leopolder |
| 6,553,724 | B1 | 4/2003 | Bigler |
| 6,576,079 | B1 | 6/2003 | Kai |
| 6,584,747 | B2 | 7/2003 | Kettler et al. |
| 6,591,568 | B1 | 7/2003 | Pålsson |
| 6,601,359 | B2 | 8/2003 | Olofsson |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,651,400 | B1 | 11/2003 | Murphy |
| 6,670,019 | B2 | 12/2003 | Andersson |
| 6,681,820 | B2 | 1/2004 | Olofsson |
| 6,685,391 | B1 | 2/2004 | Gideon |
| 6,729,091 | B1 | 5/2004 | Martensson |

(56) References Cited

U.S. PATENT DOCUMENTS 6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Gerhard
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson et al.
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,517,427 B2 4/2009 Sjoberg et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,930,862 B2 4/2011 Bergelin et al.
7,954,295 B2 6/2011 Pervan
7,980,039 B2 7/2011 Groeke
7,980,041 B2 7/2011 Pervan
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engstgröm
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Darko et al.
8,938,929 B2 1/2015 Engström
8,959,866 B2 2/2015 Pervan
9,027,306 B2 5/2015 Pervan
9,051,738 B2 6/2015 Pervan et al.
9,068,360 B2 6/2015 Darko
9,194,134 B2 11/2015 Nygren et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,359,774 B2 6/2016 Pervan
9,366,036 B2 6/2016 Pervan
9,376,821 B2 6/2016 Pervan et al.
9,382,716 B2 7/2016 Pervan et al.
9,388,584 B2 7/2016 Pervan et al.
2001/0024707 A1 9/2001 Andersson et al.
2002/0031646 A1 3/2002 Chen et al.
2002/0069611 A1 6/2002 Leopolder
2002/0092263 A1 7/2002 Schulte
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0145549 A1 8/2003 Palsson et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0139676 A1 7/2004 Knauseder
2004/0139678 A1 7/2004 Pervan

(56) References Cited

U.S. PATENT DOCUMENTS

2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hanning
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2005/0252130 A1 11/2005 Martensson
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0236642 A1 10/2006 Pervan
2006/0260254 A1 11/2006 Pervan et al.
2006/0272262 A1 12/2006 Pomberger
2007/0006543 A1* 1/2007 Engstrom ..... E04F 15/02 52/582.1
2007/0011981 A1 1/2007 Eisermann
2007/0028547 A1 2/2007 Grafenauer
2007/0065293 A1 3/2007 Hannig
2007/0108679 A1 5/2007 Grothaus
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1* 3/2008 Pervan et al. ..... 52/588.1
2008/0104921 A1 5/2008 Pervan et al.
2008/0110125 A1 5/2008 Pervan
2008/0134607 A1 6/2008 Prevan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0302044 A1 12/2008 Johansson
2009/0019806 A1 1/2009 Muehlebach
2009/0064624 A1 3/2009 Sokol
2009/0100782 A1 4/2009 Groeke et al.
2009/0133353 A1 5/2009 Pervan et al.
2009/0151290 A1 6/2009 Liu
2009/0173032 A1 7/2009 Prager et al.
2009/0193741 A1 8/2009 Capelle
2009/0193748 A1 8/2009 Boo et al.
2009/0193753 A1 8/2009 Schitter
2009/0217615 A1 9/2009 Engstrom
2009/0241460 A1 10/2009 Beaulieu
2009/0308014 A1* 12/2009 Muehlebach ..... 52/592.4
2010/0043333 A1* 2/2010 Hannig ..... 52/582.2
2010/0083603 A1 4/2010 Goodwin
2010/0170189 A1 7/2010 Schulte
2010/0173122 A1 7/2010 Susnjara
2010/0281803 A1 11/2010 Cappelle
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0016815 A1 1/2011 Yang
2011/0030303 A1 2/2011 Pervan et al.
2011/0041996 A1 2/2011 Pervan
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0131916 A1 6/2011 Chen
2011/0154763 A1 6/2011 Bergelin et al.
2011/0167750 A1 7/2011 Pervan
2011/0167751 A1 7/2011 Engstrom
2011/0173914 A1 7/2011 Engström
2011/0197535 A1 8/2011 Baker et al.
2011/0225921 A1 9/2011 Schulte
2011/0225922 A1 9/2011 Pervan et al.
2011/0252733 A1 10/2011 Pervan
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1 2/2012 Vermeulen et al.
2012/0055112 A1 3/2012 Engström
2012/0124932 A1 5/2012 Schulte et al.
2012/0151865 A1 6/2012 Pervan et al.
2012/0174515 A1 7/2012 Pervan
2012/0174520 A1 7/2012 Pervan
2012/0174521 A1 7/2012 Schulte et al.
2012/0192521 A1 8/2012 Schulte
2012/0279161 A1 11/2012 Håkansson et al.
2012/0304590 A1 12/2012 Engström
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Darko et al.
2013/0263454 A1 10/2013 Boo et al.
2013/0263547 A1 10/2013 Boo
2013/0283719 A1 10/2013 Döhring et al.
2013/0318906 A1 12/2013 Pervan et al.
2014/0007539 A1 1/2014 Pervan et al.
2014/0020324 A1 1/2014 Pervan
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Darko
2014/0109506 A1 4/2014 Pervan et al.
2014/0123586 A1 5/2014 Pervan et al.
2014/0130437 A1 5/2014 Cappelle
2014/0144096 A1 5/2014 Vermeulen et al.
2014/0150369 A1 6/2014 Hannig
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0366476 A1 12/2014 Pervan

(56) References Cited

U.S. PATENT DOCUMENTS

| | | | |
|---|---|---|---|
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0089896 | A2 | 4/2015 | Pervan et al. |
| 2015/0121796 | A1 | 5/2015 | Pervan |
| 2015/0167318 | A1 | 6/2015 | Pervan |
| 2015/0211239 | A1 | 7/2015 | Pervan |
| 2015/0233125 | A1 | 8/2015 | Pervan et al. |
| 2015/0267419 | A1 | 9/2015 | Darko |
| 2015/0300029 | A1 | 10/2015 | Pervan |
| 2015/0330088 | A1 | 11/2015 | Derelov |
| 2016/0060879 | A1 | 3/2016 | Pervan |
| 2016/0069088 | A1 | 3/2016 | Boo et al. |
| 2016/0076260 | A1 | 3/2016 | Pervan et al. |
| 2016/0090744 | A1 | 3/2016 | Pervan et al. |
| 2016/0153200 | A1 | 6/2016 | Pervan |
| 2016/0168866 | A1 | 6/2016 | Pervan et al. |
| 2016/0186426 | A1 | 6/2016 | Boo |
| 2016/0194884 | A1 | 7/2016 | Pervan et al. |
| 2016/0201336 | A1 | 7/2016 | Pervan |

FOREIGN PATENT DOCUMENTS

| | | | |
|---|---|---|---|
| DE | 2 159 042 | | 6/1973 |
| DE | 33 43 601 | A1 | 6/1985 |
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A | 5/1997 |
| DE | 299 22 649 | U1 | 4/2000 |
| DE | 200 01 788 | U1 | 6/2000 |
| DE | 199 40 837 | A1 | 11/2000 |
| DE | 199 58 225 | A1 | 6/2001 |
| DE | 202 05 774 | U1 | 8/2002 |
| DE | 203 20 799 | U1 | 8/2002 |
| DE | 10 2004 055 951 | A1 | 7/2005 |
| DE | 10 2004 001 363 | A1 | 8/2005 |
| DE | 10 2005 002 297 | A1 | 8/2005 |
| DE | 10 2004 054 368 | A1 | 5/2006 |
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A1 | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| EP | 0 013 852 | A1 | 8/1980 |
| EP | 0 871 156 | A2 | 10/1998 |
| EP | 0 974 713 | A1 | 1/2000 |
| EP | 1 120 515 | A1 | 8/2001 |
| EP | 1 146 182 | A2 | 10/2001 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 000 610 | A1 | 12/2008 |
| EP | 2 017 403 | A2 | 1/2009 |
| EP | 2 034 106 | A1 | 3/2009 |
| FR | 1 138 595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/75247 | A1 | 10/2001 |
| WO | WO 01/77461 | A1 | 10/2001 |
| WO | WO 01/94721 | A1 | 12/2001 |
| WO | WO 01/94721 | A8 | 12/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/069094 | A1 | 8/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079128 | A1 | 9/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |

(56) References Cited

FOREIGN PATENT DOCUMENTS

| | | | |
|---|---|---|---|
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/013590 | A2 | 1/2009 |
| WO | WO 2009/066153 | A2 | 5/2009 |
| WO | WO 2009/116926 | A1 | 9/2009 |
| WO | WO 2010/006684 | A2 | 1/2010 |
| WO | WO 2010/070472 | A2 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/105732 | A1 | 9/2010 |
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/085788 | A1 | 7/2011 |
| WO | WO 2011/127981 | A1 | 10/2011 |
| WO | WO 2011/151758 | A2 | 12/2011 |

OTHER PUBLICATIONS

U.S. Appl. No. 14/646,567, Pervan.
U.S. Appl. No. 14/730,691, Pervan.
U.S. Appl. No. 14/709,913, Derelov.
LifeTips, "Laminate Flooring Tips," available at (http://flooring.lifetips.com/cat/61734/laminate-flooring-tips/index.html), 2000, 12 pages.
Pervan; Darko, et al., U.S. Appl. No. 14/701,959 entitled "Mechanical Locking system for Floor Panels," filed in the U.S. Patent and Trademark Office on May 1, 2015.
Pervan; Darko, U.S. Appl. No. 14/646,567 entitled "Mechanical Locking System for Floor Panels," filed in the U.S. Patent and Trademark Office on May 21, 2015.
Pervan; Darko, U.S. Appl. No. 14/730,691 entitled "Mechanical Locking System for Panels and Method for Installing Same," filed in the U.S. Patent and Trademark Office on Jun. 4, 2015.
Derelov, Peter, U.S. Appl. No. 14/709,913 entitled "Building Panel with a Mechanical Locking System," filed in the U.S. Patent and Trademark Office on May 12, 2015.
U.S. Appl. No. 14/483,352, Pervan, et al.
U.S. Appl. No. 14/597,578, Pervan.
International Search Report mailed Apr. 15, 2011 in PCT/SE2010/051479, Swedish Patent Office, Stockholm, Sweden, 6 pages.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Pervan, Darko, et al., U.S. Appl. No. 14/483,352, entitled "Mechanical Locking System for Floor Panels," filed in the U.S. Patent and Trademark Office on Sep. 11, 2014.
Pervan, Darko, U.S. Appl. No. 14/597,578 entitled "Mechanical Locking of Floor Panels with a Glued Tongue," filed in the U.S. Patent and Trademark Office on Jan. 15, 2015.
Pervan, Darko, et al., U.S. Appl. No. 15/048,252, entitled "Mechanical Locking System for Floor Panels," filed in the U.S. Patent and Trademark Office Feb. 19, 2016.
Pervan, Darko, U.S. Appl. No. 15/148,820, entitled "Mechanical Locking System for Panels and Method of Installing Same," filed in the U.S. Patent and Trademark Office May 6, 2016.
Pervan, Darko, U.S. Appl. No. 14/938,612, entitled "Mechanical Locking System for Floor Panels," filed in the U.S. Patent and Trademark Office on Nov. 11, 2015.
Pervan, Darko, U.S. Appl. No. 14/951,976, entitled "Mechanical Locking System for Floor Panels," filed in the U.S. Patent and Trademark Office on Nov. 25, 2015.
Pervan, Darko, et al., U.S. Appl. No. 14/962,291, entitled "Mechanical Locking System for Floor Panels," filed in the U.S. Patent and Trademark Office on Dec. 8, 2015.
U.S. Appl. No. 15/217,023, Pervan, et al.
Pervan, Darko, et al., U.S. Appl. No. 15/217,023, entitled "Mechanical Locking System for Floor Panels," filed in the U.S. Patent and Trademark Office on Jul. 22, 2016.
U.S. Appl. No. 15/160,311, Pervan.
U.S. Appl. No. 15/172,926, Pervan, et al.
U.S. Appl. No. 15/175,768, Pervan, et al.
Pervan, Darko, U.S. Appl. No. 15/160,311, entitled "Mechanical Locking System for Floor Panels," filed in the U.S. Patent and Trademark Office May 20, 2016.
Pervan, Darko, et al., U.S. Appl. No. 15/172,926, entitled "Mechanical Locking of Floor Panels with a Flexible Bristle Tongue," filed in the U.S. Patent and Trademark Office on Jun. 3, 2016.
Pervan, Darko, et al., U.S. Appl. No. 15/175,768, entitled "Mechanical Locking Systems for Floor Panels," U.S. Patent and Trademark Office on Jun. 7, 2016.

* cited by examiner

MECHANICAL LOCKING SYSTEM FOR FLOOR PANELS

CROSS REFERENCE TO RELATED APPLICATIONS

The present application is a continuation of U.S. application Ser. No. 14/011,042, filed on Aug. 27, 2013, which is a continuation of U.S. application Ser. No. 12/977,399, filed on Dec. 23, 2010, now U.S. Pat. No. 8,544,230, and claims the benefit of U.S. Provisional Application No. 61/294,217, filed on Jan. 12, 2010, and claims the benefit of Swedish Application No. 1050018-9, filed on Jan. 12, 2010. The entire contents of each of U.S. application Ser. No. 14/011,042, U.S. application Ser. No. 12/977,399, U.S. Provisional Application No. 61/294,217 and Swedish Application No. 1050018-9 are hereby incorporated herein by reference.

TECHNICAL FIELD

The invention generally relates to the field of mechanical locking systems for floor panels and building panels especially floor panels with mechanical locking systems, which are possible to lock with a vertical displacement.

FIELD OF APPLICATION OF THE INVENTION

Embodiments of the present invention are particularly suitable for use in floating floors, which are formed of floor panels which are joined mechanically with a locking system integrated with the floor panel, i.e. mounted at the factory, that are made up of one or more upper layers of veneer, decorative laminate or decorative plastic material, an intermediate core of wood fibre based material or plastic material and preferably a lower balancing layer on the rear side of the core. The following description of known technique, problems of known systems and objects and features of the invention will therefore, as a non-restrictive example, be aimed at this field of application and in particular at paper based or paper free laminate flooring formed as rectangular floor panels with long and shorts sides intended to be mechanically joined on both long and short sides. The long and short sides are mainly used to simplify the description of the invention. The panels can be squared and can have more than four sides, which are not parallel or perpendicular to each other.

It should be emphasized that embodiments of the invention can be applied to any floor panel and it could be combined with all types of known locking system, where the floor panels are intended to be joined using a mechanical locking system connecting the panels in the horizontal and vertical directions on at least two adjacent sides. The invention can thus also be applicable to, for instance, solid wooden floors, parquet floors with a core of wood or wood fibre based material and a surface of wood or wood veneer and the like, floors with a printed and preferably also varnished surface, floors with a surface layer of plastic or cork, linoleum, rubber or similar. Even floors with hard surfaces such as stone, tile and similar are included and floorings with soft wear layer, for instance needle felt glued to a board. Embodiments of the invention can also be used for joining building panels which preferably contain a board material for instance wall panels, ceilings, furniture components and similar.

BACKGROUND OF THE INVENTION

Laminate flooring usually comprising a core of 6-12 mm fibreboard, a 0.2-0.8 mm thick upper decorative surface layer of laminate and a 0.1-0.6 mm thick lower balancing layer of laminate, plastic, paper or like material. A laminate surface comprising a melamine impregnated paper. Recently printed surfaces and wood fibre based paper free laminate surfaces have been developed. The most common core material is a fibreboard with high density and good stability usually called HDF—High Density Fibreboard. Sometimes also MDF—Medium Density Fibreboard—is used as core.

Laminate floor panels are generally joined mechanically by means of so called mechanical locking systems. These systems comprise locking means, which lock the panels horizontally and vertically. The mechanical locking systems are usually formed by machining the core of the panel. Alternatively, parts of the locking system can be formed of separate materials, which are integrated with the floor panel, i.e. joined with the floor panel in connection with the manufacture thereof.

The main advantages of floating floors with mechanical locking systems are that they are easy to install. Preferably, they can also easily be taken up again and used once more at a different location.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane (HP) or principal plane" is meant a plane, which extends parallel to the outer part of the surface layer. Immediately juxtaposed upper parts of two adjacent joint edges of two joined floor panels together define a "vertical plane (VP)" perpendicular to the horizontal plane. By "horizontally" is meant parallel to the horizontal plane and by "vertically" parallel to the vertical plane. By "up or upwardly" is meant towards the front side and by "down or downwardly" is meant towards the rear side. By "inwardly" is meant essentially horizontally towards the inner part of the panel and by "outwardly is meant essentially horizontally and away from the inner part of the panel. By "strip panel" is meant a panel comprising a strip and a locking element. By "groove panel" is meant a panel with a locking groove intended to cooperate with a locking element for horizontal locking.

Known Technique and Problems Thereof

The description of the known art below is in applicable parts also used in embodiments of the invention.

For mechanical joining of long sides as well as short sides in the vertical and horizontal direction several methods and locking systems could be used. One of the most used methods is the angle-snap method and one of the most used locking systems is a system made in one piece with the core. The long sides are installed by angling. The panel is then displaced in locked position along the long side. The short sides are locked by horizontal snapping.

An alternative method is the so-called angling-angling method whereby long and short sides are locked with angling.

Recently a new and simpler method has been developed where all floor panels can be joined with just an angling of the long edges. This installation method generally referred to as "fold down" installation method is described in FIGS. 1-4. The locking of the short edges 1*a*, 1*b* takes place with a scissors like movement where a flexible tongue 31 is displaced inwardly gradually from one edge to the other edge when a long side of a panel 1*c* in one row is connected by angling to an adjacent panel 1*a* in a previously installed row. The flexible snap tab, which in most cases is made of a plastic section, is during folding bended horizontally along the joint. A part of the snap tab is during folding almost in a locked position, as shown in FIG. 1, and other parts are in contact with the adjacent edge, FIG. 2, or in an completely unlocked position, as shown in FIG. 4.

Some versions of flexible tongues which are generally made of an extruded plastic section have an inner part, which is connected in a holding groove 32 and an outer flexible snap tab pointing downwards 33 that during folding snaps into a tongue groove 31 of an adjacent panel 1*c*. The flexible tongue is generally connected to an edge of the strip panel. It could also be connected to the groove panel. The snap tab is in such a version extending upwards.

The main problem with known flexible tongue 30 as shown in FIG. 2 is that it is difficult to lock due to limited flexibility. The contact point P between the groove panel and the flexible snap tab 33 is at an upper part when the groove panel is folded down along the vertical plane VP. The snap tab is also rather rigid due to the fact that the vertical extension T1 is less than 0.3 times the floor thickness T. The snap tab is also pushed inwardly and intersects the vertical plane VP. The holding groove must be made rather large in order to provide stability and this is a disadvantage.

FIGS. 5*a* and 5*b* show a snap tab with improved flexibility. It has an inner part 30*a* and an outer part 30*b* that are flexible. The snap tab must be displaced in the holding groove during locking and this requires tight tolerances. The snap is displaced into the holding groove 32, which must have a considerable horizontally extending depth.

FIGS. 6*a* and 6*b* show a locking system on the market where the contact point P is on the upper part of the flexible snap tab, which is displaced inwardly beyond the vertical plane in order to improve flexibility. The groove must be rather deep and this effect the stability of the edge in a negative way.

FIGS. 6*c* and 6*d* show another locking system on the market, which is made of three parts, two rather rigid parts 30*a*, 30*b* and one flexible rubber like part 30*c*.

FIGS. 6*e*, 6*f* show a locking system with a simple cross section, which is schematically shown in WO 2007/079845, FIG. 22, where the flexible snap tab 33 is made of a narrow rectangular cross-section that is bent or curved shaped. The snap tab is bended outside the vertical plane. The disadvantage is that the vertical extension of the holding groove is very small and difficult to produce with rotating tools. The flexible tongue 30 is difficult to fix into the groove and has a limited flexibility. The main disadvantage is however that the snap tab is bent around a centre point CP that is in contact with the lower part of the groove 32. This will in most cases cause a breaker or a permanent bending in many materials especially an extruded plastic material. The embodiment combines three major disadvantages: a) a deep holding groove, b) limited flexibility of the snap tab and c) high snapping resistance.

All the shown known embodiments have snap tabs, which have a vertical extension T1 that is smaller than 0.3 times the floor thickness T, and this creates a considerable snapping resistance during folding especially if it is combined with contacts points P at the upper part of the snap tab.

The function of a locking system with a snap tab could be improved if flexibility of the snap tab could be increased and if the horizontal extension of the holding groove could be reduced.

BRIEF DESCRIPTION OF THE INVENTION AND OBJECTS THEREOF

An objective of certain embodiments of the present invention is to provide an improved mechanical locking system comprising a flexible tongue with an outer flexible snap tab, which could by locked by vertical folding.

More specifically the object is to provide a vertical snap locking system, which creates less snapping resistance and which has a more stable edge than the known systems.

The objective is to improve the stability of the edge mainly with holding grooves that allow a strong connection between a flexible tongue and the holding groove and that have a smaller horizontal extension inwardly into the core of the panel than present known systems.

The above objects of certain embodiments of the invention are achieved wholly or partly by a mechanical locking systems and floor panels, as described herein. Further embodiments of the invention are evident from the claims, description and drawings.

According to a first aspect of certain embodiments of the invention, a set of floor panels are provided which are mechanically connectable to each other along one pair of adjacent edges, so that upper joint edges of said floor panels in the connected state define a vertical plane. Each of said floor panels comprising a flexible tongue on a first edge of the panel and a tongue groove on a second opposite edge of the panel for receiving the flexible tongue of an adjacent panel for mechanically locking together said adjacent edges vertically parallel to the vertical plane and at right angles to a horizontal plane of the panels.

The tongue groove is formed in a core of the panel and is open towards the vertical plane. A locking element is formed in one piece with the panel at the first edge and a locking groove at the opposite second edge. The locking groove being open towards a rear side of the panel that faces a subfloor.

The locking element and the locking groove form a horizontal mechanical connection perpendicular to the vertical plane, the locking element having a locking surface that is adapted to directly contact a locking surface of the locking groove for locking the panels to each other horizontally parallel to the horizontal plane and at right angles to the joined first and second edges.

The flexible tongue comprises resilient parts formed of a separate material than the core, and cooperates with a locking surface in the tongue groove.

Wherein two of the panels can be mechanically joined together by displacement of said two panels vertically towards each other, while at least an outer part of the flexible tongue, comprising a flexible snap tab extending downwards is resiliently displaced inwardly, substantially around a centre point located at an upper part of the flexible tongue and spaced from the lower part of the holding groove, to an inner position which is outside the vertical plane, until said adjacent edges of the two panels are brought into engagement with each other vertically and the flexible snap tab is displaced towards its initial position away from the vertical plane and against the tongue groove.

The flexible tongue has an inner part mounted in a sideward open holding groove in the first edge that is open towards the vertical plane. The inner part is fixed in the sideward open holding groove.

The outer flexible part, e.g., the flexible snap tab, has a cross section with a maximum thickness of the outer flexible part (e.g., the flexible snap tab), and the locking surface being offset in relation to the vertical plane by at least the maximum thickness of the flexible snap tab.

According to a second aspect of certain embodiments of the invention, a set of floor panels are provided which are mechanically connectable to each other along one pair of adjacent edges, so that upper joint edges of said floor panels in the connected state define a vertical plane. Each of said floor panels comprising a flexible tongue on a first edge of the panel and a tongue groove on a second opposite edge of the panel for receiving the flexible tongue of an adjacent panel for mechanically locking together said adjacent edges vertically parallel to the vertical plane and at right angles to a horizontal plane of the panels.

The tongue groove is formed in a core of the panel and is open towards the vertical plane. A locking element is formed in one piece with the panel at the first edge and a locking groove at the opposite second edge. The locking groove being open towards a rear side of the panel that faces a subfloor.

The locking element and the locking groove form a horizontal mechanical connection perpendicular to the vertical plane, the locking element having a locking surface that is adapted to directly contact a locking surface of the locking groove for locking the panels to each other horizontally parallel to the horizontal plane and at right angles to the joined first and second edges.

The flexible tongue comprises resilient parts formed of a separate material than the core, and cooperates with a locking surface in the tongue groove.

Wherein two of the panels can be mechanically joined together by displacement of said two panels vertically towards each other, while at least an outer part of the flexible tongue, comprising a flexible snap tab extending downwards is resiliently displaced inwardly until said adjacent edges of the two panels are brought into engagement with each other vertically and the flexible snap tab is displaced towards its initial position away from the vertical plane and against the tongue groove.

The flexible tongue has an inner part mounted in a sideward open holding groove in the first edge that is open towards the vertical plane. The inner part is fixed in the sideward open holding groove.

The outer flexible part, e.g., the flexible snap tab, has a cross section with a maximum thickness of the outer flexible part (e.g., the flexible snap tab), and the locking surface being offset in relation to the vertical plane by at least the maximum thickness of the flexible snap tab.

The inner part comprises one or several vertical cross sections wherein one of said vertical cross sections may be larger than said thickness of the flexible snap tab and/or another vertical cross section of the inner part.

DESCRIPTION OF EMBODIMENTS OF THE INVENTION

To facilitate understanding, several locking systems in the figures are shown schematically. It should be emphasized that improved or different functions can be achieved using combinations of the preferred embodiments.

Figure 1:
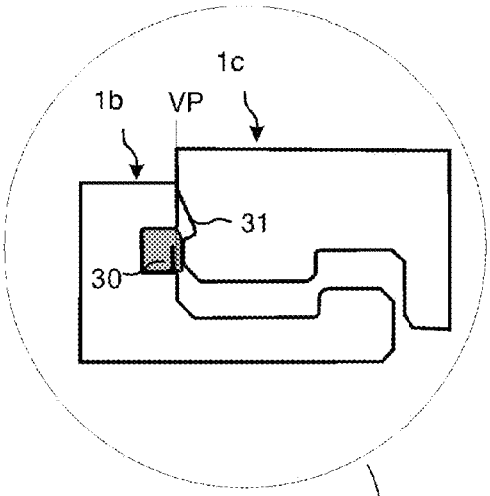
FIGS. 1-6*f* illustrate known systems.
Figure 2:
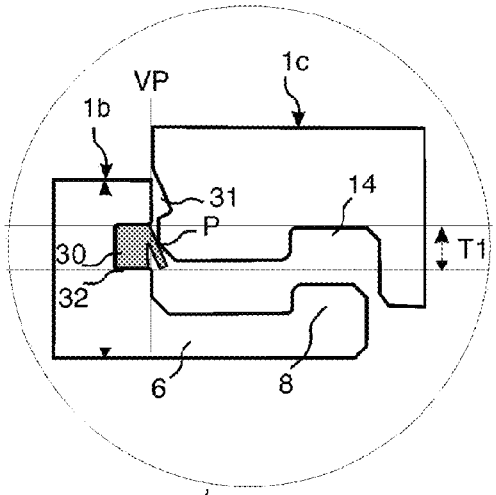
Figure 3:
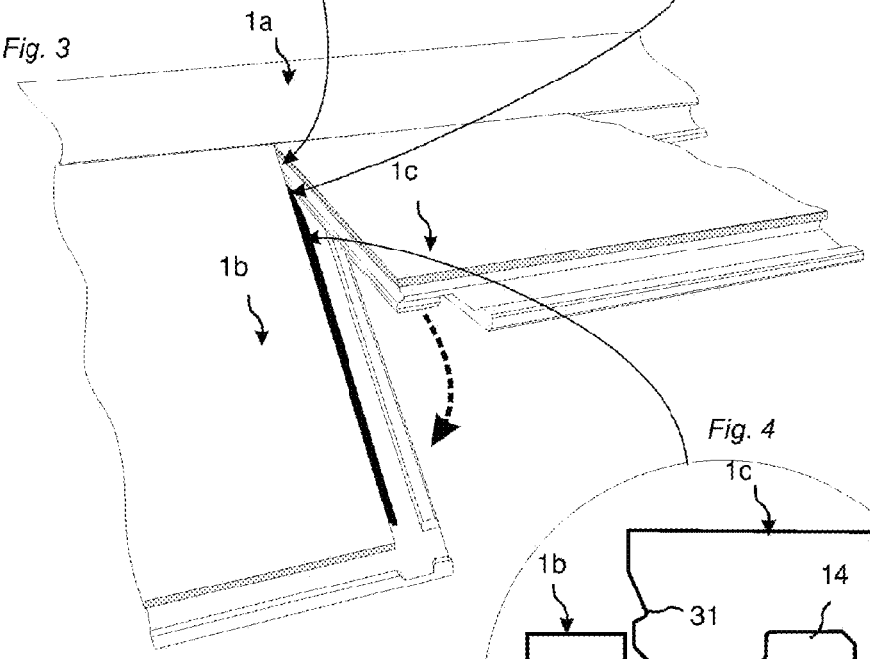
Figure 4:
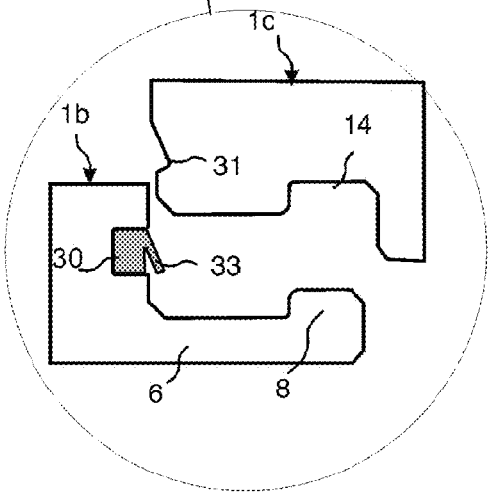
Figure 5A:
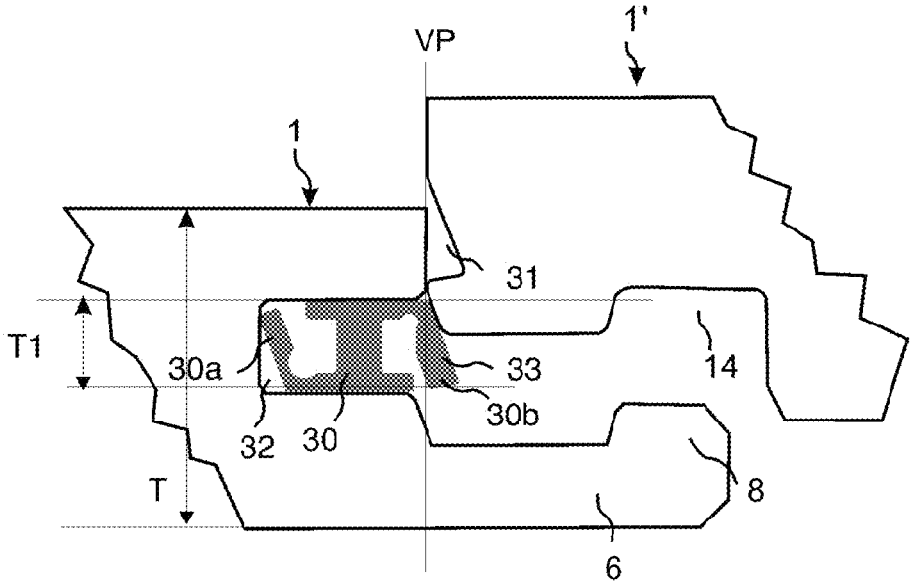
Figure 5B:
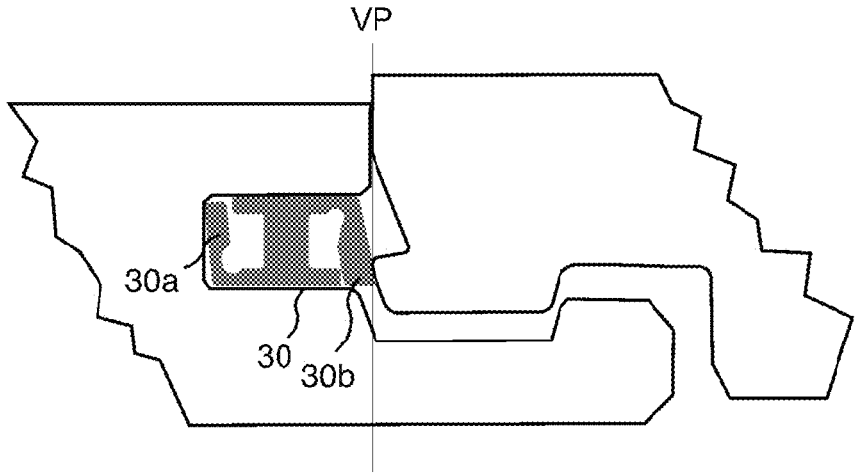
Figure 6A:
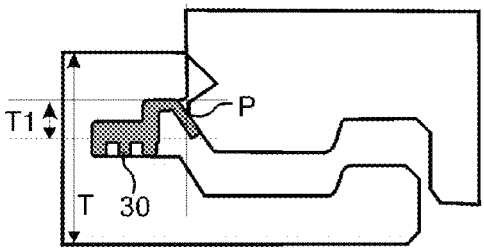
Figure 6C:
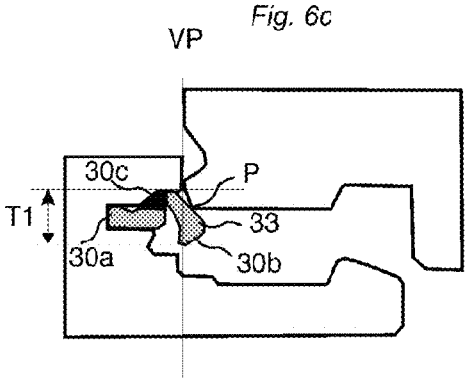
Figure 6B:
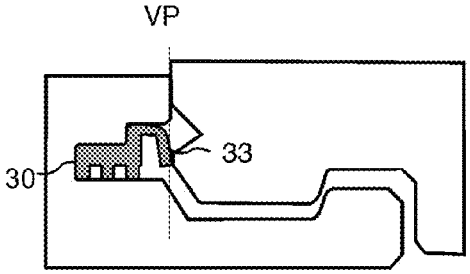
Figure 6D:
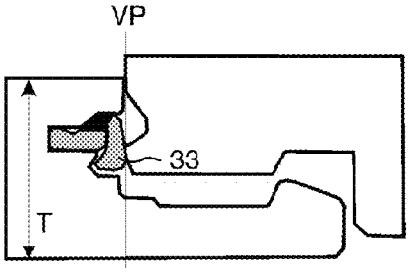
Figure 6E:
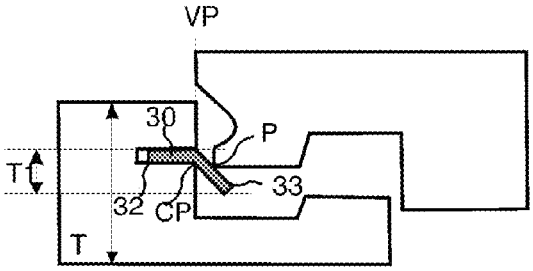
Figure 6F:
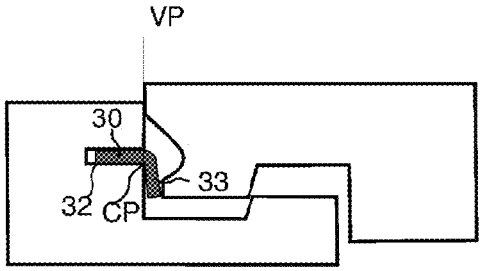
Figure 7A:
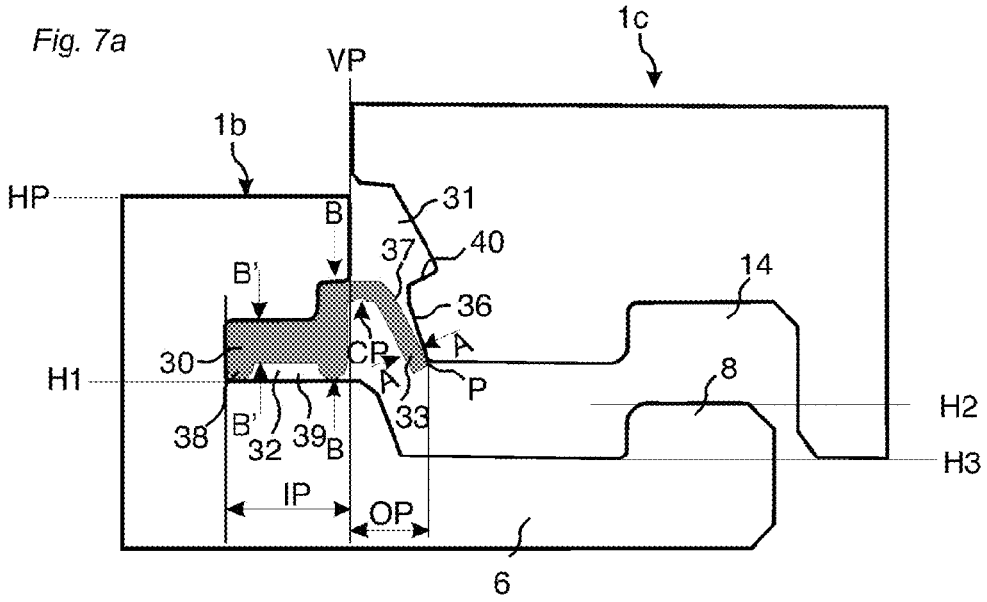
FIGS. 7*a*-7*c* illustrate a first embodiment of the invention.
Figure 7B:
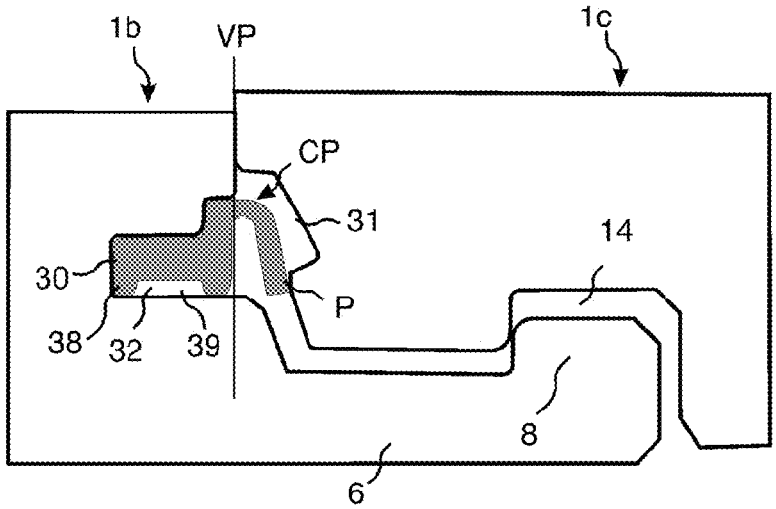
Figure 7C:
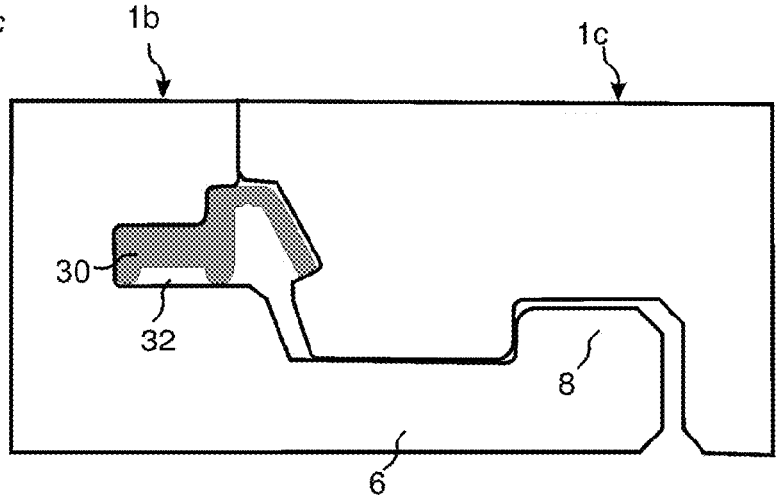

FIGS. 7*a*-7*c* show an embodiment of the invention. A strip panel 1*b* comprising a strip 6 and a locking element 8 which cooperates with a locking groove 14 in a groove panel 1*c* for horizontal locking of two adjacent edges of panels 1*b*, 1*c* is provided. The strip panel comprises a flexible tongue 30 in a holding groove 32, which is open towards the vertical plane VP and has an inner part IP connected to the holding groove. The flexible tongue has an outer part OP outside the vertical plane VP comprising a flexible snap tab 33 that cooperates with a locking surface 40 of a tongue groove 31 in an adjacent edge 1*c* of the groove panel 1*c* and locks the edges vertically parallel to the vertical plane VP.

The snap tab is during the whole locking motion positioned outside the vertical plane VP and is during locking displaced inwardly towards the vertical plane and outwardly away from the vertical plane as shown in FIGS. 7*b* and 7*c*. The snap tab is during the displacement bended around a centre point which is located at an upper part of the flexible tongue 30 and is preferably spaced vertically upwards from the lower part of the holding groove 32 and/or horizontally outwardly from the vertical plane VP. The snap tab is preferably spaced from the vertical plane in its inner position. The inner part of the snap tab could also preferably be aligned with the vertical pane.

Such an embodiment makes it possible to decrease the amount of material that has to be removed in order to form a holding groove. The horizontal extension of the holding groove 32 could be decreased and even the opening could be smaller. This improves the stability of the edge. The improved stability could be combined with a maintained or even improved flexibility of the snap tab.

The groove panel 1*c* comprises a lower part 36, which is preferably formed as a bevel, and preferably more vertically inclined than the outer part 37 of the flexible snap tab. The first contact point P between the groove panel 1*c* and the flexible tongue 30 is preferably located at the lower part of the flexible snap tab 33 when the groove panel 1*c* is displaced vertically along the vertical plane VP towards the strip panel 1*b*. Such an embodiment will decrease the snapping resistance considerably.

The lower part of the holding grove 32 is preferably located in a horizontal plane H1 which is vertically offset upwardly from a vertical plane H3 that intersects the upper part of the strip 6 and preferably also from a horizontal plane H2 that intersects the upper part of the locking element. This facilitates the fixing of the tongue into the holding groove. The holding grove could also be inclined upwardly from an inner to an outer position. This is an advantage, which could be used in all snap tab systems, such as the known art systems previously discussed, to facilitate the fixing of the flexible tongue. Embodiments of the known art systems previously discussed with an inclined holding groove are included within the scope of the invention.

The flexible tongue has preferably a thickness A-A at its outer part OP that is smaller than a vertical thickness B-B located in the inner part IP. The inner part IP of the flexible tongue 30 comprises preferably two vertical cross sections B-B, B'-B', with different vertical thicknesses and preferably a space 39 between a lower and/or upper part of the flexible groove. Such an embodiment makes it possible to combine a stable connection of the flexible tongue, to save material and to improve flexibility.

The locking surface 40 is offset to the vertical plane by at least the maximum thickness A-A of the flexible snap tab 33.

The inner part of the flexible tongue 30 can substantially fill the volume of the sideward open holding groove or can comprise one or several friction connection 38 that extends downwards and/or upwards.

The described motion of a flexible snap tab outside the vertical plane and a first contact point at a lower part of the snap tab could be used separately to improve locking but preferably in combination. It is an advantage to use a low contact point even in embodiments where the snap tab is displaced inwardly beyond the vertical plane.

Figure 8A:
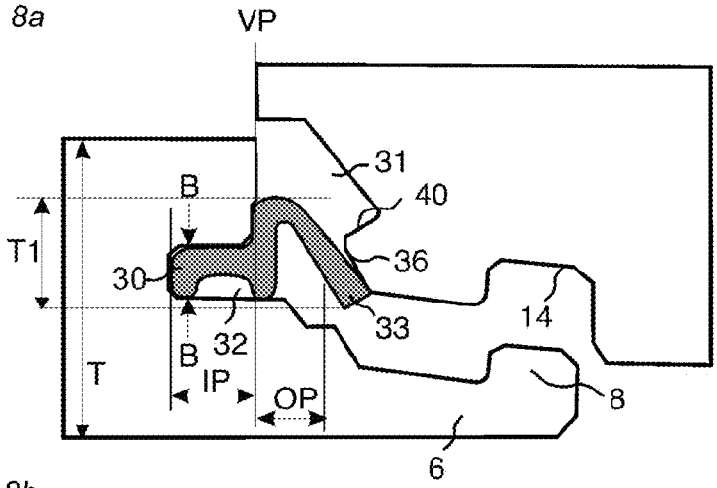
FIGS. 8*a*-8*d* illustrate a second embodiment of the invention.
Figure 8B:
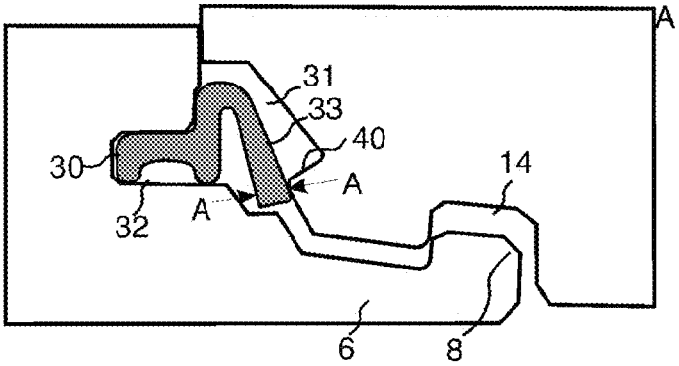
Figure 8C:
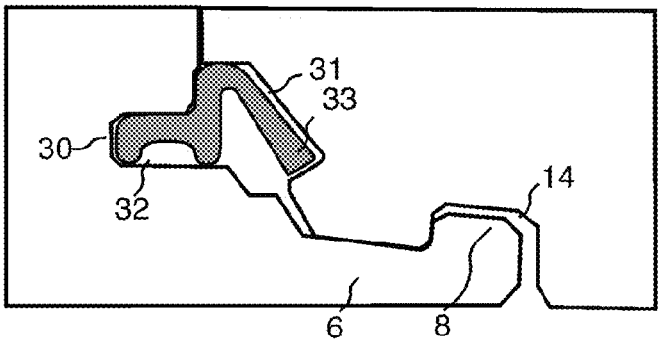

FIGS. 8*a*-8*c* show that the snap tab 33 could preferably be formed with a vertical extension T1 that is equal or larger than 0.3 times the floor thickness T. It is even more preferred to increase this vertical extension to 0.35 or even to more than 0.40 times the floor thickness T. This is especially preferable in wood floors where a high locking strength could be combined with an easy locking.

Such an embodiment could be used to decrease the locking resistance further especially if it is combined with one or both of the two other desired features described above.

Figure 8D:
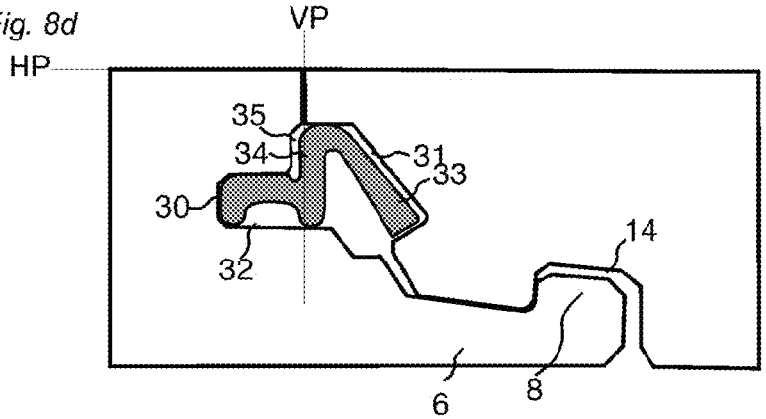

FIG. 8*d* shows an embodiment where the upper part 34 of the flexible tongue 30 can be bended horizontally inwardly, preferably to a position inside the vertical plane VP. When the upper part of the snap tab is in locked position, a space 35 exists between the flexible tongue and the holding groove 32. The upper part of the flexible tongue is displaced in the space 35 during locking. This can be used to reduce snapping resistance and to increase the flexibility of the flexible tongue.

Figure 9A:
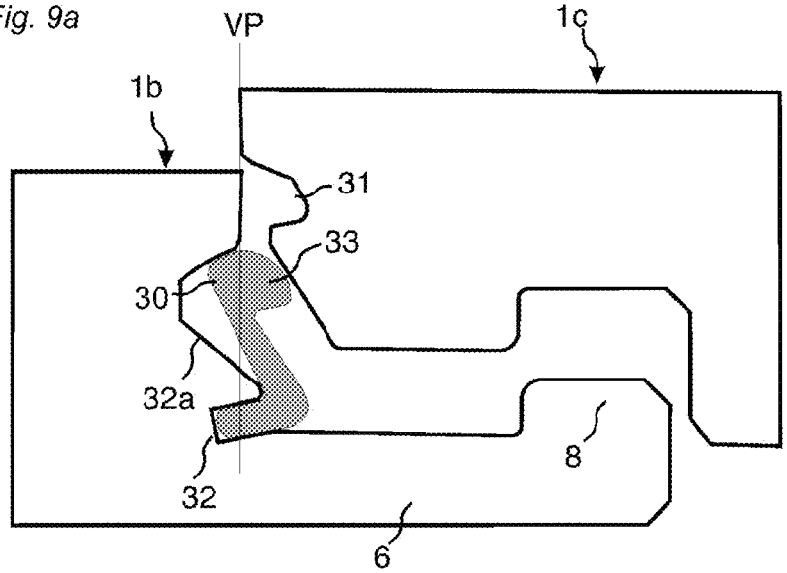
FIGS. 9*a*-9*c* illustrate a third embodiment of the invention.
Figure 9B:
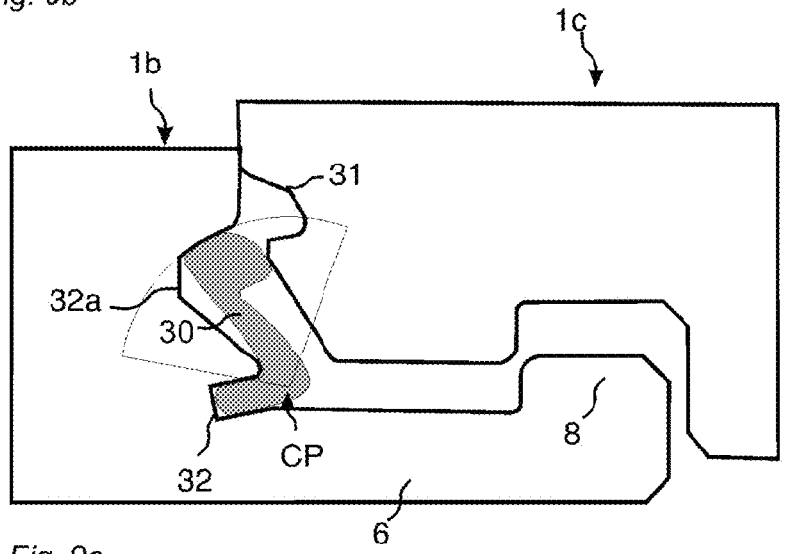
Figure 9C:
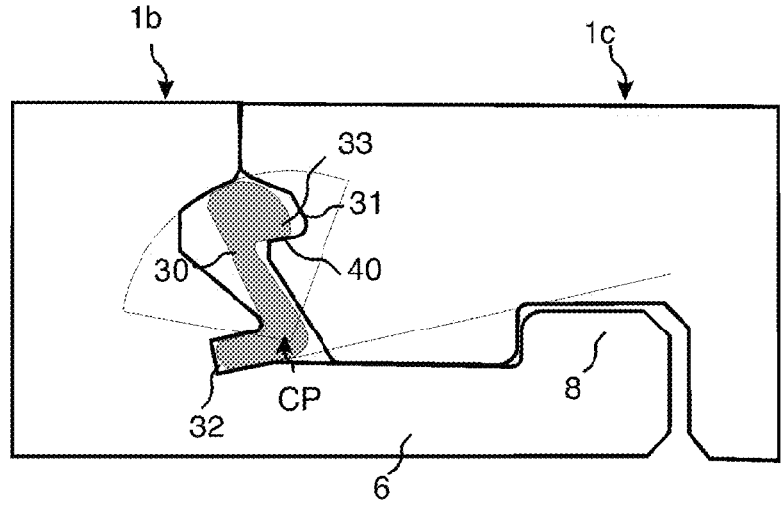

FIGS. 9*a*-9*c* show a preferred embodiment of a flexible tongue 30, which is connected in a fixed manner in a holding groove 32 of the strip panel 1*b* and comprises a flexible part 33 that is displaceable in a displacement groove 32*a*. Such an embodiment allows increased flexibility since the vertical distance between the lower part of the tongue that is connected in the holding groove 32 and the upper part 33 that locks against the locking surface 40 of the tongue groove 31, could be increased.

The flexible snap tab 33 is during folding displaced horizontally inwards and outwards in the displacement groove 32*a* and bending occurs preferably and essentially around a centre point C located in a lower part of the flexible tongue 30.

The holding groove 32 is located vertically below the displacement groove 32*a*. The locking surface 40 of the tongue groove 31 is preferably spaced vertically upwards in relation to the holding groove 32 and these two grooves are preferably located in different horizontal planes one over the other. The holding grove 32 is preferably located vertically below the upper part of the locking element 8 and is preferably inclined upwards in relation to a horizontal plane in order to facilitate the insertion of the flexible tongue 31 into the holding groove 32.

Such a flexible tongue could also be connected to an edge of the groove panel 1*c*. The holding groove 32 is in such an embodiment preferably located in the upper part of the panel edge and the displacement groove 32*a* below the holding groove 32.

Figure 10A:
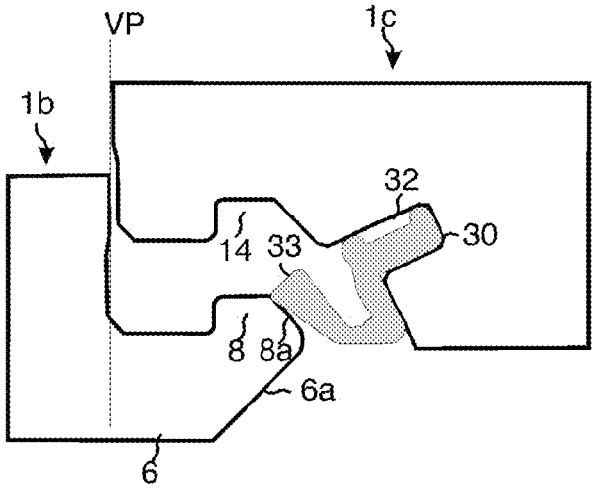
FIGS. 10*a*-10*c* illustrate a flexible tongue fixed to an edge of the fold panel.
Figure 10B:
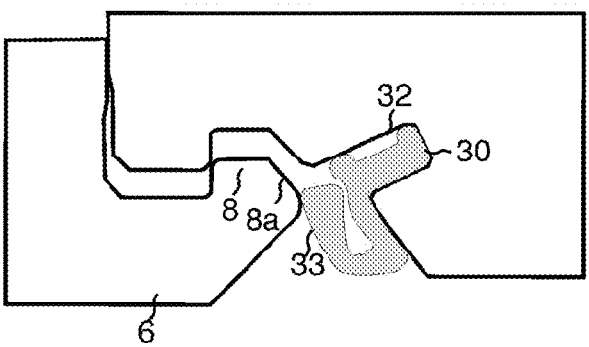
Figure 10C:
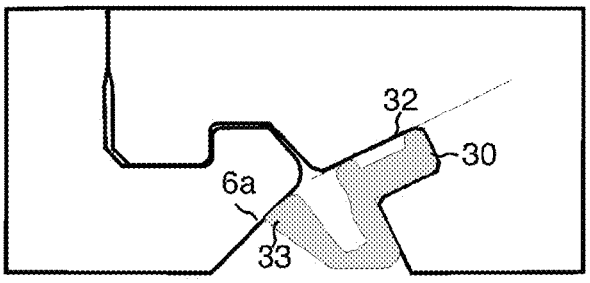

FIGS. 10*a*-10*c* show that a flexible tongue could be connected to a holding groove 32 in the groove panel 1*c* and that the holding groove 32 is spaced inwardly from the locking groove 14. The holding groove 32 could even in this embodiment preferably be inclined against the horizontal plane.

FIGS. 10*b* and 10*c* show that the flexible snap tab 33 during locking slides against the upper and outer part 8*a* of the locking element 8. This part 8*a* is in this embodiment inclined. It could for example also be rounded. The outer part 33 of the snap tab locks against a locking surface 6*a* formed on the outer part of the strip 6. This locking surface 6*a* could be inclined downwards or upward, essentially horizontal or rounded.

Figure 10D:
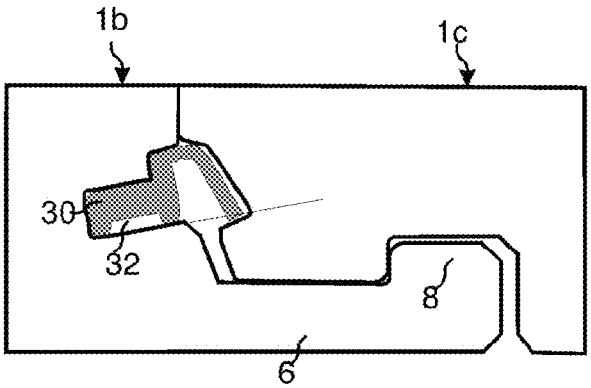
FIG. 10*d* illustrates a flexible tongue fixed in an inclined groove.

FIG. 10*d* shows that all embodiments shown in FIGS. 7 and 8 could be connected to a holding grove 32 that is inclined in order to facilitate the fixing of the flexible tongue 30 when a holding groove 32 is formed in the strip panel 1*b*.

The invention claimed is:

1. A set of floor panels which are mechanically connectable to each other along one pair of adjacent first and second edges, so that upper joint edges of said floor panels in the connected state define a vertical joint plane, each of said floor panels comprising:

a flexible tongue on a first edge of a floor panel;

a tongue groove on an opposite second edge of the floor panel for receiving the flexible tongue of an adjacent floor panel for mechanically locking together said first and second edges vertically parallel to the vertical joint plane and at a right angle to a horizontal plane of the floor panels, wherein the tongue groove is formed in a core of the floor panel and is open towards the vertical joint plane; and a locking element formed in one piece with the floor panel at the first edge and a locking groove at the opposite second edge, the locking groove being open towards a rear side of the floor panel that faces a subfloor, wherein the locking element and the locking groove form a horizontal mechanical connection perpendicular to the vertical joint plane, the locking element having a locking surface that is configured to directly contact a locking surface of the locking groove for locking the floor panels to each other horizontally parallel to the horizontal plane and at a right angle to the joined first and second edges;

wherein the flexible tongue comprising an upper resilient part formed of a separate material than the core of the floor panel, and cooperates with a locking surface in the tongue groove;

wherein the upper resilient part is displaceable in a displacement groove;

wherein a lower part of the flexible tongue is connectable in a fixed manner in a holding groove at the first edge, the holding groove including a top wall, a bottom wall, and a side wall connecting the top wall to the bottom wall, and at least the top wall is vertically below the displacement groove, wherein two of the floor panels are configured to be mechanically joined together by displacement of said two floor panels vertically towards each other while the upper resilient part is resiliently displaced inwardly from an initial position, which is outside the vertical joint plane, to an inner position toward the first edge until said adjacent edges of the two floor panels are brought into engagement with each other vertically, and the upper resilient part is displaced towards its initial position away from the vertical joint plane and against the tongue groove.

2. The set of floor panels as claimed in claim 1, wherein flexible tongue is configured to bend around a center point located in a lower part of the flexible tongue.

3. The set of floor panels as claimed in claim 2, wherein the holding groove is located vertically below the displacement groove.

4. The set of floor panels as claimed in claim 1, wherein the holding groove is located vertically below the displacement groove.

5. The set of floor panels as claimed in claim 1, wherein the locking surface of the tongue groove is vertically above the holding groove.

6. The set of floor panels as claimed in claim 1, wherein the tongue groove and the holding groove are located in different horizontal planes.

7. The set of floor panels as claimed in claim 1, wherein the holding groove is located vertically below the upper part of the locking element.

8. The set of floor panels as claimed in claim 1, wherein the holding groove is inclined upwards in relation to the horizontal plane.

9. The set of floor panels as claimed in claim 1, wherein the flexible tongue is configured to bend horizontally along the first edge during locking.

10. The set of floor panels as claimed in claim 1, wherein a lower part of the second edge and the flexible tongue are configured such that a first contact point between the second edge and the flexible tongue is located at the upper resilient part of said flexible tongue when the second edge is displaced along the vertical joint plane towards the first edge.

11. The set of floor panels as claimed in claim 1, wherein the flexible tongue is made of extruded polymer material.

12. The set of floor panels as claimed in claim 1, wherein the second edge comprises a lower part formed as a bevel.

13. The set of floor panels as claimed in claim 1, wherein the upper resilient part of said flexible tongue crosses the vertical joint plane before displacement two panels vertically towards each other during an operation to connect the first and second edges together.

* * * * *